US005546844A

United States Patent [19]

Krumm et al.

[11] Patent Number: 5,546,844

[45] Date of Patent: Aug. 20, 1996

[54] HYBRID PROPELLANT/ELECTROTHERMAL GUN

[75] Inventors: Herbert Krumm, Kaarst; Adolf Nordmann, Erkrath; Johannes Ehrhardt, München; Johann Lorenz, Hohenkammer; Günter Stoffler, Vierkirchen, all of Germany

[73] Assignee: Rheinmetall Industrie GmbH, Ratingen, Germany

[21] Appl. No.: 409,584

[22] Filed: Mar. 24, 1995

[30] Foreign Application Priority Data

Mar. 25, 1994 [DE] Germany ..... 44 10 327.1

[51] Int. Cl.[6] ..... F41B 6/00; F41A 21/02

[52] U.S. Cl. ..... 89/8; 89/16

[58] Field of Search ..... 89/8, 16; 124/3

[56] References Cited

U.S. PATENT DOCUMENTS 2,783,684 3/1957 Yoler ..... 89/8

FOREIGN PATENT DOCUMENTS

| | | | |
|---|---|---|---|
| 0412897 | 2/1991 | European Pat. Off. . | |
| 3344636 | 6/1984 | Germany . | |
| 3716078 | 6/1990 | Germany | 89/8 |
| 3910566 | 10/1990 | Germany . | |
| 4132657 | 4/1993 | Germany . | |
| 2132322 | 7/1984 | United Kingdom . | |

*Primary Examiner*—Stephen C. Bentley
*Attorney, Agent, or Firm*—Spencer & Frank

[57] ABSTRACT

A gun barrel for a hybrid propellant/electrothermal gun has a first barrel portion; a second barrel portion axially separated from the first barrel portion; and an insulator unit forming a third barrel portion. The insulator unit connects the first and second barrel portions to one another and defines a plasma path. There is further provided an arrangement for placing the first barrel portion on a first electric potential and for placing the second barrel portion on a second electric potential. The first and second potentials are different from one another for generating, in the plasma path, an electric arc having an orientation parallel to the barrel axis for heating propellant gases which initially accelerate the projectile.

11 Claims, 2 Drawing Sheets

HYBRID PROPELLANT/ELECTROTHERMAL GUN

CROSS REFERENCE TO RELATED APPLICATION

This application claims the priority of German Application No. P 44 10 327.1 filed Mar. 25, 1994, which is incorporated herein by reference.

BACKGROUND OF THE INVENTION

This invention relates to a hybrid propellant/electrothermal gun in which, for increasing the acceleration of the projectile, electric energy is introduced into a plasma length portion (plasma path) of the weapon barrel.

Hybrid propellant/electrothermal guns are known. They are guns for firing conventional ammunition and, to increase the projectile acceleration, a plurality of electrode pairs are disposed along the weapon barrel. The electrodes of each pair are situated diametrically opposite relative to the barrel axis. As the projectile passes an electrode pair, a high-energy arc is generated perpendicularly to the direction of projectile advance (that is, perpendicularly to the barrel axis), heating the propellant gases.

It is a primary disadvantage of the above-outlined prior art construction that expensive electronic or mechanical control devices are needed to ignite the arcs. Further, the effective width of the arc that heats the gas is relatively narrow so that a plurality of electron pairs is required to obtain an appreciable increase of the projectile acceleration.

German Published Patent Application 41 32 657 A1 discloses an electrothermal firing device in which the breech-side end of a conventional gun is coupled with an insulated barrel portion. The plasma chamber proper is formed by a cartridge which is situated in the loading chamber and which is provided with a breech-side grounded electrode and a barrel-side, high-voltage electrode. For firing, ground potential is applied to the breech and a high potential is applied to the barrel portion which is insulated relative to the breech and which is connected with the barrel-side electrode. As a result, in the cartridge between the barrel portion and the breech an arc is generated which is oriented axially with respect to the weapon barrel. It is a primary disadvantage of this prior art arrangement that for the acceleration of large-caliber projectiles very high electric energy is needed and therefore bulky current sources are required.

SUMMARY OF THE INVENTION

It is an object of the invention to provide an improved hybrid gun of the above-outlined type in which a predeterminable additional acceleration may be imparted to the projectile without the need for a plurality of arc paths.

This object and others to become apparent as the specification progresses, are accomplished by the invention, according to which, briefly stated, the gun barrel for a hybrid propellant/electrothermal gun has a first barrel portion; a second barrel portion axially separated from the first barrel portion; and an insulator unit forming a third barrel portion. The insulator unit connects the first and second barrel portions to one another and defines a plasma path. There is further provided an arrangement for placing the first barrel portion on a first electric potential and for placing the second barrel portion on a second electric potential. The first and second potentials are different from one another for generating, in the plasma path, an electric arc having an orientation parallel to the barrel axis for heating propellant gases which initially accelerate the projectile.

In essence, the invention is based on the concept of inserting into the weapon barrel an insulator unit having an integrated plasma chamber of predeterminable length. The arc which heats the propellant gases has a course similar to that described in the above-noted German Published Patent Application 41 32 657 A1. During operation, in the barrel portion on the breech side which is, as a rule, grounded, up to the plasma chamber an acceleration of the projectile occurs in a conventional manner by virtue of the propellant gases generated upon firing. As soon as the projectile has traversed the insulating barrel portion formed by the insulator unit, and is in contact with the muzzle-side barrel portion of high potential, an ignition (arc generation) along the barrel axis occurs between the projectile base and the breech-side barrel zone. The propellant gases are heated up in that zone, resulting in a pressure increase and thus in an increase of the projectile acceleration.

In such an arrangement the insulator unit containing the plasma chamber is of particular significance because it has to be configured such that upon firing of particularly large-caliber projectiles not only the two axially spaced barrel portions have to be electrically insulated from one another but also it should be capable of absorbing the high internal pressure as well as the axial loads and barrel oscillations. The bending resistance (course of the moment of inertia) of the insulator unit has to be adapted such that it substantially corresponds to that of the barrel at rest.

The insulator unit is preferably includes two metal coupling parts between which, in the zone of the plasma path, a sleeve of insulating material (insulating sleeve) having a wear-resistant inner surface is positioned. The insulating sleeve and the coupling parts are interconnected in a form-fitting manner by means of an insulating body. The insulating body preferably comprises a plurality of layers of fiber composite material formed of a polymer matrix or a ceramic matrix. The fiber composite components of the insulating body may be wound about the metal coupling parts and the insulating sleeve or may be glued or shrunk thereto.

Also, the insulating body may be formed of a pressed mass; in such a case, the form-locking (fixed) connection with the coupling parts is obtained by a pressing process. The insulating sleeve may be made in an extrusion process, pressing process or winding process, from thermoplastic duroplastic or ceramic material. For reinforcing these materials organic or inorganic fibers in different orientations or manufacture may be used.

To achieve a pre-stressed state of the insulator unit in the circumferential direction, on the insulating body a preferably conical or cylindrical tubular cover sleeve made of metal or synthetic material is shrunk or pressed (protection against bursting).

According to a further advantageous embodiment of the invention, for an additional axial load transmission by the insulating body, both ends of the burst protector cover sleeve are stepped and are form-fittingly affixed to sleeves made of a fiber composite material.

According to a further advantageous feature of the invention, the insulating sleeve may be omitted and the insulating body itself may be utilized for defining the plasma path between the two axially spaced barrel portions. In such a case it has been found to be advantageous to provide the inner hollow cylindrical surface of the insulating body with a wear-resistant layer, for example, a ceramic coating applied by spraying. Or, it is feasible instead to fit into the insulating body a preferably replaceable insert made of a wear-resistant synthetic or ceramic material.

To obtain an additional reinforcement in the region of the plasma path, it has been found to be particularly advantageous to provide mutually facing, axial prolongations of the metal coupling parts. The axial prolongations are embedded in the insulating body.

In order to ensure a highly satisfactory force transmission from the metal coupling parts to the insulating body, the metal coupling parts are configured as stepped sleeves. Further, the metal coupling parts are surface-treated for a better adherence, such as sandblasted or chemically roughened so that an additional optimal glue connection may be provided.

DESCRIPTION OF THE PREFERRED EMBODIMENT

Figure 1:
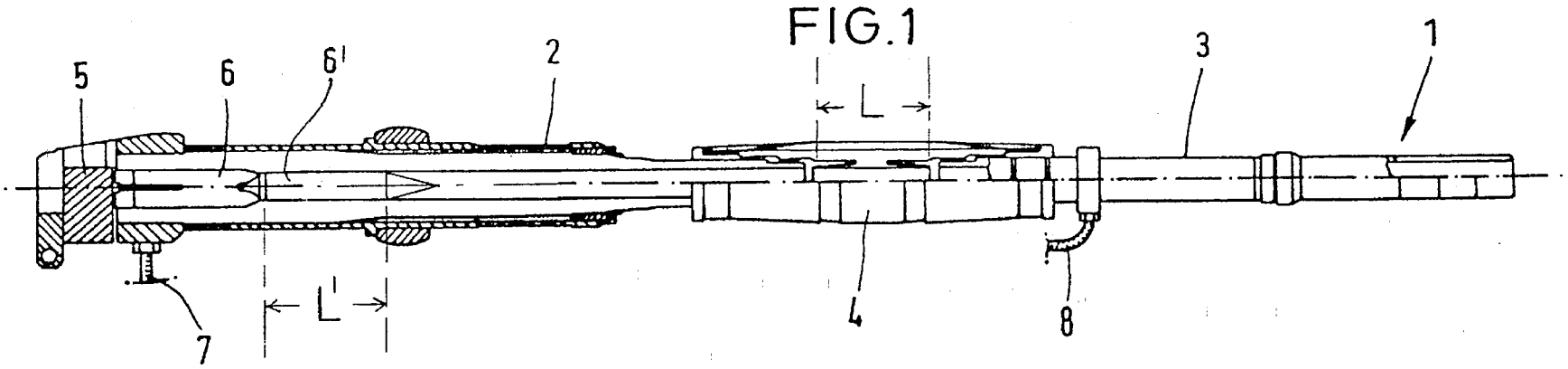
FIG. 1 is a side elevational view, partially in section, of a weapon barrel of a hybrid propellant/electrothermal gun provided with an insulator unit according to a preferred embodiment of the invention.

Turning to FIG. 1, there is illustrated therein the barrel 1 of a tank gun. The barrel is composed essentially of two axially spaced barrel portions 2 and 3 which are approximately of the same length and which are interconnected by an insulator unit 4 according to the invention. The barrel portion 2 is a weapon barrel of a conventional tank gun which has a breechblock 5 and from which ammunition 6 is fired by means of an appropriate propellant. The barrel portion 2 and the breechblock 5 are connected to zero potential (that is, they are grounded) and are connected by means of a conductor 7 with a corresponding electrode of a current source (which is not shown for clarity).

The barrel portion 3 has a current terminal 8 which is connected to a high voltage terminal of the current source. As the projectile, accelerated by propellant gases, passes from the barrel portion 2 to the barrel portion 3 and is in an electric contact with the latter, due to the high potential difference between the projectile base and the barrel portion 2, an electric arc is generated which heats the propellant gases, augments their expansion (pressure) and thus, as a result, increases the acceleration of the projectile. The barrel portion 3 may be on its outside provided with an insulating layer to protect against contacting as it is described in more detail, for example, in German Published Application 41 32 657 A1.

Figure 2:
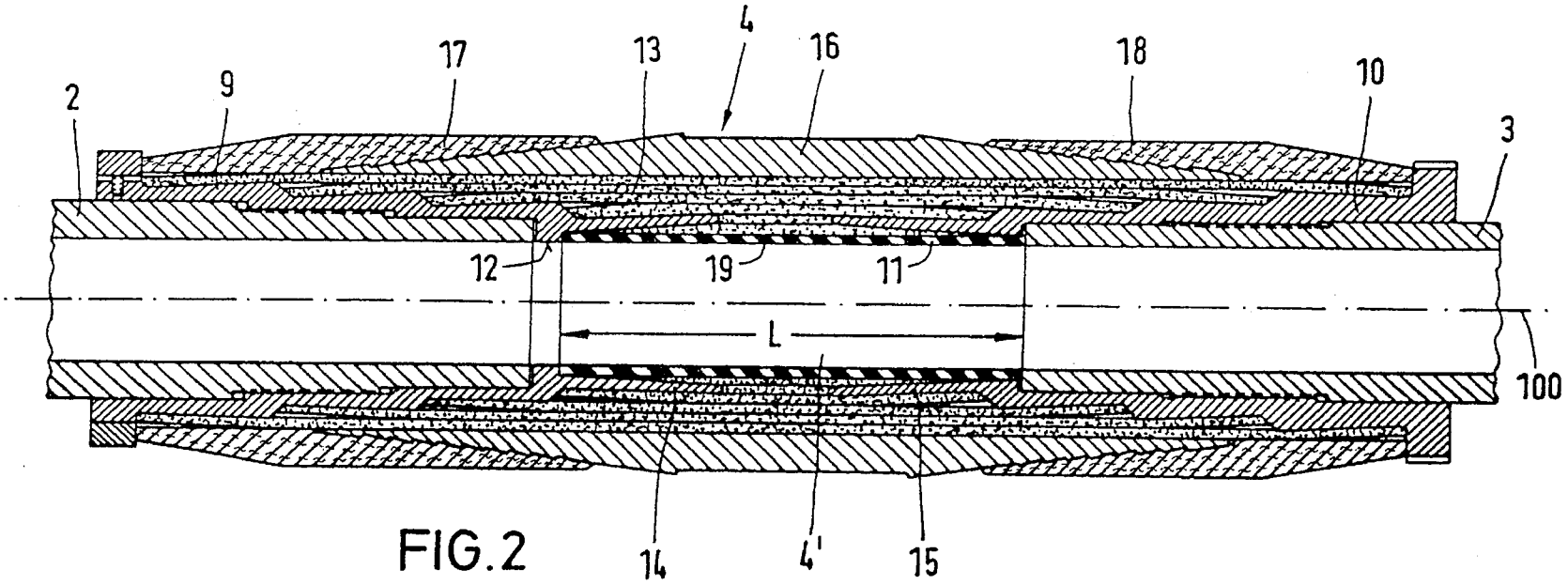
FIG. 2 is an enlarged axial sectional view of the insulator unit illustrated in FIG. 1.

Turning to FIG. 2, there are shown details of the insulator unit 4 which defines a plasma path 4'. The insulator unit 4 includes two tubular metal coupling parts 9 and 10 arranged end-to-end in the direction of the longitudinal axis 100 of the barrel 1. Between the coupling parts 9, 10 there is provided an insulating sleeve 11 which is made, for example, of a ceramic material and whose internal cylindrical cavity defines the plasma path 4'. The coupling parts 9, 10 are stepped sleeves having inner and outer steps to which the likewise stepped barrel portions 2 can be affixed in a form-locking manner. Further, the end 12 of the coupling part 9 which is oriented towards the insulating sleeve 11 constitutes an annular electrode to which the potential of the barrel portion 2 is applied. Such an annular electrode may also be provided on the coupling part 10.

The length L of the plasma path 4' and thus that of the insulating sleeve 11 are so selected that they are shorter than or equal to the length of the projectile portion which is in electric contact with the barrel 1. Thus, in case of a full-caliber projectile 6' shown in FIG. 1 and having an electrically conductive outer face, L has to be smaller than or equal to the length L' of the projectile. In case of a subcaliber projectile with 2-flange sabots made of aluminum, the length L should be less than or equal to the distance between the two sabot flanges.

Coupling parts 9, 10 and the insulating sleeve 11 are form-fittingly connected with an insulating body 13 formed of several layers of a fiber composite material made of a polymer matrix or a ceramic matrix. The connecting parts 9, 10 have respective, generally axially oriented extensions 14, 15 which are enclosed by the insulating body 13. The effect of the abrupt change of stiffness between the metal coupling parts 9, 10 on the one hand and the insulating body 13, on the other hand, is minimized by a dual cone shape of the coupling parts 9, 10 which contributes to the form-locking effect. To obtain a prestressed state of the insulator unit 4 in the circumferential direction, a conical or cylindrical steel sleeve 16 is shrunk or pressed onto the insulating body 13. Further, to increase the load transmission of the insulating body 13 in the axial direction, both ends of the sleeve 16 are stepped and are connected with likewise stepped end sleeves 17, 18 made of a fiber composite material.

Instead of using a separate insulating sleeve 11 for defining the plasma path 4' the insulating body 13 itself may be utilized. In such a case it has been found to be expedient to provide the inner surface 19 of the insulating body 13 in the region of the plasma path 4' with a wear-resistant layer, for example, a sprayed-on ceramic coating or a preferably replaceable insert sleeve made of a wear-resistant plastic or ceramic. Such inserts may be connected with the insulating body 13 by shrinking, gluing or press-fitting.

The insulating body 13 may be manufactured, for example, in a wet winding process to obtain a pore-free, homogeneous fiber composite material with high fiber content. Based on the significant wall strengths and the requirement for high-quality laminates, the manufacturing process has to be usually performed in several steps. This concerns the winding process as well as the hardening (curing) process (stepwise hardening).

The orientation of the fibers is, by means of the winding process, adapted to the strength and stiffness requirements. The reinforcing fibers may be fabric bands, rovings or a combination thereof.

It is also feasible to make the insulating body from a pressed mass; the form-locking relationship with the metal coupling parts is achieved by the pressing process. The insulating sleeve may be made either in an extrusion process, a pressing process or a winding process from a thermoplastic, duroplastic or ceramic material. For reinforcing these materials, organic or inorganic fibers of different orientation may be used.

As reinforcing fibers, preferably glass fibers, synthetic fibers, ceramic fibers and to a limited extent, also carbon fibers or metal fibers may be used.

As a matrix preferably epoxide resins with appropriate reagents, melamine resins, bismaleinimide resins, polyimide resins, phenol resins or polyester resins may be used.

It is to be understood that the invention is not limited to the above-described embodiments. Thus, for example, the connection between the barrel portions 2 and 3 and the coupling parts 9, 10 may be effected by means of a threaded joint or a bayonet lock instead of a shrink-on connection.

It will be understood that the above description of the present invention is susceptible to various modifications, changes and adaptations, and the same are intended to be comprehended within the meaning and range of equivalents of the appended claims.

What is claimed is:

1. A gun barrel for a hybrid propellant/electrothermal gun adapted to fire a projectile by propellant gases and to increase acceleration of the projectile by introducing electric energy into a barrel length portion containing a plasma path; said gun barrel having a barrel axis and comprising (a) a first barrel portion;

(b) a second barrel portion axially separated from said first barrel portion;

(c) an insulator unit forming a third barrel portion; said insulator unit connecting said first and second barrel portions to one another and defining a plasma path; said insulator unit including (1) a first metal coupling part surrounding an end portion of said first barrel portion; said end portion being oriented toward said plasma path;

(2) a second metal coupling part surrounding an end portion of said second barrel portion; said end portion of said second barrel portion being oriented toward said plasma path; said first and second metal coupling parts being axially spaced from one another;

(3) a component unit of electrically insulating fiber composite material disposed between said first and second metal coupling parts; said component unit having an inner face defining said plasma path; said component unit fixedly interconnecting said first metal coupling part and said second metal coupling part; and (4) a cover sleeve surrounding said component unit; and (d) electric potential applying means for placing said first barrel portion on a first electric potential and for placing said second barrel portion on a second electric potential; said first and second potentials being different from one another for generating, in said plasma path, an electric arc having an orientation parallel to said axis for heating the propellant gases.

2. The gun barrel as defined in claim 1, further comprising a wear-resistant lining carried on said inner face; said wear-resistant lining defining and bounding said plasma path.

3. The gun barrel as defined in claim 2, wherein said wear-resistant lining is a replaceable insert fitted into said inner face.

4. The gun barrel as defined in claim 2, wherein said wear-resistant lining is a coating applied to said inner face.

5. A gun barrel for a hybrid propellant/electrothermal gun adapted to fire a projectile by propellant gases and to increase acceleration of the projectile by introducing electric energy into a barrel length portion containing a plasma path; said gun barrel having a barrel axis and comprising (a) a first barrel portion;

(b) a second barrel portion axially separated from said first barrel portion;

(c) an insulator unit forming a third barrel portion; said insulator unit connecting said first and second barrel portions to one another and defining a plasma path; said insulator unit including (1) a first metal coupling part surrounding an end portion of said first barrel portion; said end portion being oriented toward said plasma path;

(2) a second metal coupling part surrounding an end portion of said second barrel portion; said end portion of said second barrel portion being oriented toward said plasma path; said first and second metal coupling parts being axially spaced from one another;

(3) an insulating sleeve disposed between said first and second metal coupling parts; said insulating sleeve having an inner face defining said plasma path;

(4) an insulating body fixedly interconnecting said first metal coupling part, said second metal coupling part and said insulating sleeve; said insulating body being formed of a fiber composite material; and (5) a cover sleeve surrounding said insulating body; and (d) electric potential applying means for placing said first barrel portion on a first electric potential and for placing said second barrel portion on a second electric potential; said first and second potentials being different from one another for generating, in said plasma path, an electric arc having an orientation parallel to said axis for heating the propellant gases.

6. The gun barrel as defined in claim 5, wherein said first and second metal coupling parts are sleeves stepped down towards one another.

7. The gun barrel as defined in claim 5, wherein an end portion of at least one of said first and second metal coupling parts oriented toward said plasma path constitutes an annular electrode; said annular electrode being electrically connected to said electric potential applying means.

8. The combination of the gun barrel as defined in claim 5 with a projectile to be fired from the gun barrel; said projectile having a length portion being in electric contact with said gun barrel when said projectile being fired therefrom; said plasma path having a maximum axial length corresponding to said length portion of said projectile.

9. The gun barrel as defined in claim 5, said first and second metal coupling parts having an end oriented toward said plasma path; each said end of said first and second metal coupling parts being provided with an extension fixedly embedded into said insulating body.

10. The gun barrel as defined in claim 5, wherein said cover sleeve has opposite stepped end portions; further comprising first and second terminal sleeves surrounding said first and second metal coupling parts, respectively, and being fixedly connected with said stepped end portions.

11. The gun barrel as defined in claim 5, wherein said fiber composite material of said insulating body is composed of fibers and a matrix; further wherein said fibers are selected from the group consisting of glass fibers, synthetic fibers, ceramic fibers, carbon fibers and metal fibers and said matrix is selected from the group consisting of epoxy resins including reagents, melamine resins, bismaleineimide resins, polyimide resins, phenol resins and polyester resins.

* * * * *